US009322132B2

(12) United States Patent
Etschmaier et al.

(10) Patent No.: US 9,322,132 B2
(45) Date of Patent: Apr. 26, 2016

(54) CORROSION-RESISTANT ROLLER COATING

(71) Applicant: Voith Patent GmbH, Heidenheim (DE)

(72) Inventors: Alexander Etschmaier, Neuberg (AT); Jürgen Angerler, Steyrermühl (AT); Hasso Jungklaus, Gmunden (AT); Goar Hesselmann, Laakirchen (AT)

(73) Assignee: Voith Patent GmbH, Heidenheim (DE)

( * ) Notice: Subject to any disclaimer, the term of this patent is extended or adjusted under 35 U.S.C. 154(b) by 50 days.

(21) Appl. No.: 14/077,669

(22) Filed: Nov. 12, 2013

(65) Prior Publication Data

US 2014/0127526 A1 May 8, 2014

Related U.S. Application Data

(63) Continuation of application No. PCT/EP2012/056422, filed on Apr. 10, 2012.

(30) Foreign Application Priority Data

May 13, 2011 (DE) ..... 10 2011 075 810

(51) Int. Cl.
*F16C 13/00* (2006.01)
*B21K 1/02* (2006.01)
(Continued)

(52) U.S. Cl.
CPC .. *D21F 1/40* (2013.01); *D21F 3/08* (2013.01); *D21G 1/02* (2013.01); *D21G 1/0246* (2013.01); *Y10T 29/49563* (2015.01);
(Continued)

(58) Field of Classification Search
CPC ..... D21F 3/105; D21F 3/08; D21G 1/02; D21G 1/0246; Y10T 428/12049; Y10T 428/12535; Y10T 428/12549; Y10T 428/12556; Y10T 428/12569; Y10T 29/49563; C23C 4/06; C23C 4/08; C23C 4/124; C23C 4/125; C23C 4/127
USPC ..... 492/20, 26, 48, 53, 54, 56; 427/405, 427/409, 454, 455, 456; 29/895.32; 100/155 R
See application file for complete search history.

(56) References Cited

U.S. PATENT DOCUMENTS 3,526,939 A * 9/1970 Nikkanen ..... 29/895.212
3,817,656 A * 6/1974 Batteux ..... F16D 33/20 416/180
(Continued)

FOREIGN PATENT DOCUMENTS

DE 202012012593 U1 * 9/2013 ..... D21F 5/021
WO 94/09208 A1 4/1994

OTHER PUBLICATIONS

Notice of Transfer of International Research Report and the Written Notice issued for International Searching Authority or Statement dated May 23, 2012 for International Application No. PCT/EP2012/056422 (11 pages).

*Primary Examiner* — Essama Omgba
(74) *Attorney, Agent, or Firm* — Taylor IP, P.C.

(57) ABSTRACT

A method for applying a corrosion-protective coating to a roller component includes the steps of providing a device for thermal spray coating, providing a stainless steel material, coating at least one part of the surface of the roller component by applying the stainless steel material using the device for thermal spray coating and sealing the applied coating by a polymer material.

22 Claims, 1 Drawing Sheet

(51) Int. Cl.
*D21F 1/40* (2006.01)
*D21F 3/08* (2006.01)
*D21G 1/02* (2006.01)

(52) U.S. Cl.
CPC . *Y10T 428/12049* (2015.01); *Y10T 428/12549* (2015.01); *Y10T 428/12556* (2015.01); *Y10T 428/12569* (2015.01)

(56) References Cited

U.S. PATENT DOCUMENTS 3,942,230 A 3/1976 Nalband
4,609,577 A * 9/1986 Long ..... 428/683
4,856,161 A * 8/1989 Miihkinen ..... 492/54
5,111,567 A 5/1992 Leino et al.
5,257,966 A 11/1993 Watanabe et al.
5,268,045 A * 12/1993 Clare ..... C23C 4/02 148/518
5,268,405 A * 12/1993 Ojakaar et al. ..... 524/366
5,283,121 A 2/1994 Bordner
5,979,314 A * 11/1999 White ..... B41F 7/26 101/148
6,623,601 B2 * 9/2003 Graf et al. ..... 162/272
2009/0196542 A1 * 8/2009 Guenther et al. ..... 384/569
2012/0249636 A1 * 10/2012 Kitabayashi ..... B41J 2/04506 347/10

* cited by examiner

CORROSION-RESISTANT ROLLER COATING

CROSS REFERENCE TO RELATED APPLICATIONS

This is a continuation of PCT application No. PCT/EP2012/056422, entitled "CORROSION-RESISTANT ROLLER COATING", filed Apr. 10, 2012, which is incorporated herein by reference.

BACKGROUND OF THE INVENTION

1. Field of the Invention

The current invention relates to a corrosion resistant coating of rollers for use in paper machines.

2. Description of the Related Art

During the production of paper which, in this document, is to be understood to include all cellulose containing fibrous webs, for example cardboard, nonwoven fabrics and similar, the rolls of the paper machine are subjected to process water and steam with electrolytic conductivity. In order to prevent these aggressive mediums reaching the roll cores manufactured from base metals the rolls, or respectively the roll cores, are coated with a corrosion resistant material.

As a corrosion protective coating for rolls, or respectively roll cores, galvanic hard chrome layers and hard metal layers applied by means of thermal spray coating is used. The galvanic chrome plating provides an effective corrosion protection which can be produced cost effectively. However due to toxicity of the used electroplating baths, this must be categorized as being an environmentally harmful method. Moreover, mechanical cleaning of galvanic hard chrome layers is difficult due to the brittle characteristics of chrome. A composite material of tungsten carbide hard materials embedded in a cobalt-nickel-matrix is normally used as hard metal coating layers which are applied to the surface by means of a thermal spray process, for example HVOF (high velocity oxygen fuel, high velocity flame spraying). The application of thermal hard metal spray layers occurs in several cycles, that is in several partial layers, in order to ensure the physical homogeneity of the coating.

Hard metal coatings applied in a thermal spraying process are characterized by effective corrosion protection and high abrasion resistance. Adhesion of contaminants occurring during paper production is comparatively low on hard metal surfaces, so that these can be cleaned relatively easily through doctoring. However, the production of thermal hard metal coating compared to chrome plating is very cost intensive.

At less critical locations in a paper machine, for example guide rolls for fabrics or felts, where the corrosion protective coating does not come into contact with the paper surface, the more cost-effective galvanic hard chrome plating is therefore currently used which is, however, linked to greater environmental pollution. This type of hard chrome plating can however not be doctored.

What is needed in the art is a cost effective corrosion protection which, compared to galvanic hard chrome plating, is less harmful to the environment but nevertheless effective for roll components.

SUMMARY OF THE INVENTION

The present invention provides a suitable corrosion protection achieved with a method which includes steps for the provision of a device for thermal spray coating, the provision of a stainless steel material, coating of at least part of the surface of the roll component by applying a stainless steel material using the device for thermal spray coating, and sealing the applied coating with a polymer material.

A corrosion protected roll component for a roll according to the present invention, produced cost effectively and environmentally compatible for use in a machine for the production of paper, includes a metallic base body; one thermal spray coating consisting of a stainless steel material covering at least part of the surface of the metallic base body; and a polymer sealing layer applied to the surface of the thermal stainless steel spray coating.

Since stainless steel materials for thermal spray coatings are substantially cheaper than cermet materials, or ceramic metal composites, which can be spray coated, for example hard metals, corrosion protective coatings produced therewith are also more cost effective. Sealing of the stainless steel spray coating with a polymer prevents an attack by electrolytes on defective areas of the coating material, thereby effectively preventing corrosion of the spray coating and advancing of the corrosion causing electrolytes to the base material.

In embodiments of the inventive method for application of a corrosion protective coating onto a roll component, the provided device for thermal spray coating is configured for implementation of high velocity flame spraying or laser spraying. These thermal spray methods do not cause any significant metallurgic change in the spray material, so that the metallurgic composition of thermal spray coatings produced with these methods corresponds to that of the base material used for the coating. The stainless steel material used as the base material for the coating is, for example provided in the form of a fine powder whose particles undergo a plastic deformation on impacting the surface which is to be coated, whereby very dense layers with low porosity can be produced in a simple manner.

In other embodiments of the inventive method the provided device for thermal spray coating is configured for implementation of arc spraying, whereby the coating source material is melted in an arc and is transferred with the assistance of a carrier gas to the work piece which is to be coated. Arc spraying is especially suitable for the application of well adhering layers having thicknesses greater than 200 micrometers (μm) to several millimeters (mm) on large surfaces. In the use of thermal spray methods whereby the coating material for the application is melted through the supply of electric energy, as for example in arc spraying, the stainless steel is provided, for example in wire form to simplify the supply.

In order to achieve a high corrosion resistant thermal spray layer, a stainless steel material may be used which consists of a chrome-nickel-steel having a composition according to one of the material numbers 1.4401, 1.4404, 1.4406, 1.4435, 1.4436 or 1.4440. Stainless steels with these material numbers also meet standard 316 L or respectively 316 of the American Iron and Steel Institute (AISI).

Very dense, low porosity coatings are achieved advantageously through application of the stainless steel material onto a surface of the roll component in several strokes, in other words through several, successive separate partial coats. Dense thermal coatings having a thickness of approximately 50 to 200 μm can be achieved with 4 to 6 strokes.

For use in highly stressed locations an additional coat of an additional material may be applied, covering at least a part of the surface of the thermal spray coating of stainless steel, whereby the additional material can be a carbide, boride or nitride or a composite thereof, or a composite of a metal of the 4., 5. or 6. sub-group. The coating can be applied with the same coating method as the stainless steel coating, whereby the thickness may include an additional 1 to 3 strokes. Although this does not form a closed coating on the stainless steel, it forms at least one having a compacting function ensuring increased corrosion resistance.

The polymer material for sealing the spray coating advantageously includes an epoxy resin which thoroughly wets a stainless steel surface in non-cross-linked as well as in partially cross-linked condition, thereby ensuring a solid positive material bond. Moreover, the good wettability also ensures that the resin penetrates into the recesses of the surface, filling them completely so that no hollow spaces are formed at the interface between spray coating and polymer sealing layer. In additional embodiments, the polymer material for sealing the spray coating includes a silicone polyester resin which combines good wetting of stainless steel spray layers with an anti-adhesion and dirt-repelling effect.

Generally, fillers can also be embedded into the polymer material of the sealing layer in order to achieve an improvement of the anti-adhesion and dirt-repelling properties of its surface. In embodiments thereof according to the present invention, materials may be used for the fillers which contain poly fluorinated ethylene (PEF) and, for example polytetrafluor ethylene (PTFE). The fillers in the form of particles, for example in the form of particles having average diameters in the range of between approximately 0.1 and 5 μm are embedded into the polymer base material of the sealing layer.

Instead of an epoxide resin or silicone-polyester resin with fillers containing PFE or PTFE, the polymer can also directly consist of poly fluorinated ethylene, for example polytetrafluor ethylene, or of a polymer containing such a substance. To apply polytetrafluor ethylene onto the surface of the spray coating, polytetrafluor ethylene particles having a size in the range of approximately 50 to 100 nanometers (nm) are, for example, made into a slurry and the thereby obtained suspension is applied onto the spray coating, for example with the assistance of an immersion bath, by spraying or application with a brush or another coating device. A polymer in the form of particles may be used for this, with a size distribution whereby at least 65 percent of the particles are of one or more sizes from the range of between approximately 50 and 100 nm.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
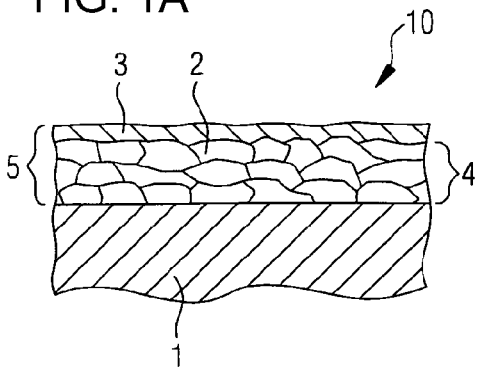
FIG. 1A illustrates a strongly schematized depiction of a corrosion protection layer according to the present invention, formed by a sealed spray coating on a roll component.

Referring now to the drawings, and more particularly to FIG. 1A, there is shown a schematized cross sectional illustration of a section of roll component 10 provided with a corrosion protected surface. The illustrated embodiment of an inventive roll component includes a roll core 1, onto the surface of which a corrosion protection layer 5 is arranged, which is formed by a spray coating 4 and a seal 3 applied thereto. Corrosion protection layer 5, for example, covers all surface regions of roll component 10 which are exposed to corrosive media in intended use of the roll. In the illustrated embodiment of the present invention, spray coating 4 is formed of individual stainless steel particles 2 which, in order to form a closed and therefore dense layer, are positively adjoined with each other. An accordingly corrosion protected roll is suitable, for example, for use as a guide roll for fabrics or felts in machines for paper production.

As the stainless steel material for spray coating 4, a non-rusting chrome-nickel-steel having a composition according to one of the material numbers 1.4401 (designation: X5CrNiMo17-12-2), 1.4404 (designation: X2CrNiMo17-12-2), 1.4406 (designation: X2CrNiMo17-11-2), 1.4435 (designation: X2CrNiMo18-14-3), 1.4436 (designation: X3CrNiMo17-13-3) or 1.4440 (designation: X2CrNiMo19-12) may be used which are characterized by their high resistance against corrosion and acids. The cited steel types also meet standards 316 or respectively 316 L of the American Iron and Steel Institute (AISI).

Figure 2A:
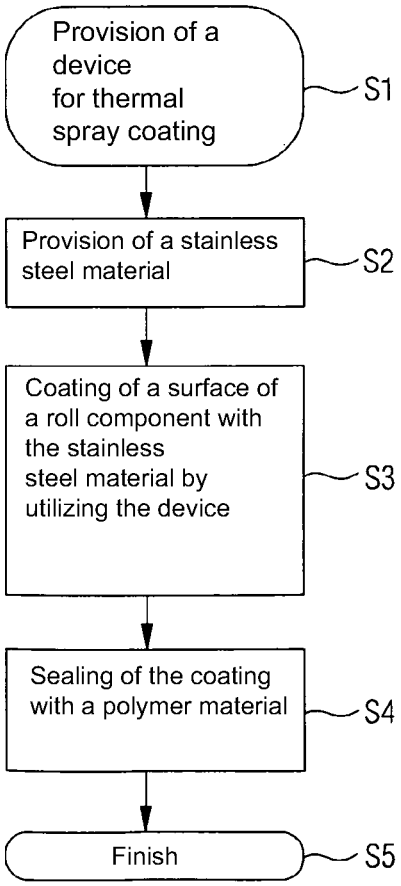
FIG. 2A illustrates the fundamental steps to produce a sealed spray coating as a corrosion protection for a roll component.

For application of coating material 2 onto base body 1 of work piece 10 in the embodiment of a roll component, a thermal spray process may be used whose basic steps are shown in FIG. 2A.

The method starts at step S1 with the provision of a device for thermal spray coating. Thermal spray coating is to be understood to be a surface coating process whereby a coating material is melted down, melted on or fused and with the assistance of a gas flow is accelerated in the direction of the surface which is to be coated. The surface of the work piece which is to be coated is thereby only slightly thermally stressed. On impact onto the work piece surface the spray particles are generally flattened and connect through mechanical bonding. A crack-free coating with a homogeneous microstructure, low porosity and good adhesion to the work piece is hereby achieved. In arc spraying melting of the wire shaped spray or coating material occurs with an electric arc; in high velocity flame spraying melting of the spray material particle occurs in the fuel-oxygen-high velocity flame and in laser spraying with the laser beam. Obviously, other spray coating methods than the ones cited as examples can be used.

In step S2 of the method illustrated in FIG. 2A for application of a corrosion protective coating on a roll component, the spray material is provided in the form of a stainless steel material, whereby, for example, non-rusting stainless steels are used, for example chrome-nickel-steels having a composition according to AISI-Standard 316 L or respectively 316 which are also identified with material numbers 1.4401, 1.4404, 1.4406, 1.4435, 1.4436 or 1.4440. The form in which the spray material is provided depends on the device which is to be coated. For arc spraying, the coating material is provided for example in wire form, for high velocity flame spraying in powder form. The dimensions of the median particle sizes of such powders is selected depending on the desired coating thickness and, since the particles are flattened on impact, may be approximately 50 μm for coating thicknesses of almost 100 to several 100 μm.

After the provision of coating device and coating material, as well as setting up of the work piece, a surface or a part of a surface of work piece 10 is coated in step S3 with the spray material using the apparatus. In order to achieve a practically pore-free or respectively dense coating the application of the spraying material occurs, for example in several strokes. The number of strokes depends on the process parameters which are set at the coating device, possibly the size of the powder particles, the distance between the work piece and the component of the device dispensing the spray material, and the desired coating thickness. Normally the number of strokes is determined by experimenting. The porosity of the spray coating can also be influenced through the process parameters of the coating process, whereby for example with high velocity flame spraying, porosities of less than 0.5% can be achieved. Porosity is hereby to be understood to be the surface percentage which, in a cross section through the tested material, is occupied by the therein contained hollow spaces.

The stainless steel spray coat applied in step S3 is sealed in step S4 with the application of a polymer material after which the corrosion protection coating process is completed in step S5 with the exception of possible post-processing refinishing of the surface.

Thermal spray coating processes are characterized by the possibility to produce coating layers having very low porosity, in other words with few hollow spaces in the coating material. The individual hollow spaces are normally not connected with each other, so that the pores do not create passages from the surface of the coating to the surface of the base work material through which a penetration of electrolytic acting substances could occur. An accordingly produced coating is therefore impervious to process water and steam which are associated with paper production.

However, under the operational conditions in a paper machine a corrosion of the spray coating can occur over the long term via defects in the coating material, for example grain boundaries and especially the inside surfaces of the coating, which are formed by the interfaces where the individual coating particles adjoin each other. In order to prevent an attack with subsequent advance of the corrosion over interfaces of this type, the coating surface is sealed with a polymer material after completion of thermal spray coating. The sealing effect is thereby not nullified by potential wear of sealing layer 3 to exposure of the upper regions of spray coating 4, since the surface of the spray coating is not ideally even but has a spatial contour, whereby the interfaces of adjoining coating particles are arranged almost exclusively in recesses.

Polymer materials suitable for providing the seal are basically all thermosetting plastics and two-component systems. Exemplary materials are such thermosetting plastics whose decomposition temperature is sufficiently far above the utilization temperature of roll components 10 that the thermosetting plastic acts elastically. Analogously suitable are thermoplastics whose glass transition temperature is so far above the utilization temperature of roll components 10 that no negative softening of the polymer can occur when utilizing spray layer 4 which is sealed with the polymer. As an approximate reference value for the minimum difference between utilization temperature and decomposition temperature or respectively glass transition temperature 20° C. can be specified. Utilization temperature is to be understood to be the operating temperature of roll component 10 during use of the blade in accordance with the present invention.

Suitable as polymers are, for example, epoxide resins and epoxide resins with filler particles embedded therein, for example consisting of poly fluorinated ethylene (PFE) and polytetrafluor ethylene (PTFE). Since epoxide resin in non-cross-linked or respectively in partially cross-linked condition displays good wetting of the coating base material, it can also penetrate into recesses of the coating surface with unfavorable aspect relationship. The viscosity of the epoxide resin can be reduced by adding solvents, for example alcohols or ketones in order to adapt the wetting to the surface contour of coating 4. The sealing process can occur with the assistance of an immersion bath, using spraying or with the assistance of coating devices, for example brushes or spatulas.

In order to form an approximately 90 μm thick spray coating with the assistance of a high velocity flame coating device, Diamond Jet Hybrid" (DJ2600) a coating material jet consistent with one of the AISI Standards 316 L is applied in one embodiment of the present invention in 4 strokes onto the surface of a steel roll core. The thus provided thermal spray coating layer is subsequently sealed with a colorless two-component system on an epoxide resin basis.

Figure 1B:
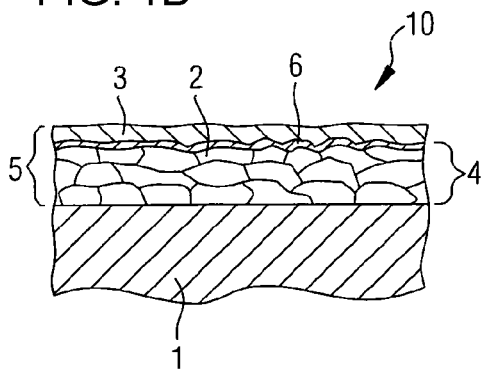
FIG. 1B is an additional embodiment of the present invention with an additional coating for the purpose of compaction.

Referring now to FIG. 1B a second embodiment of the present invention is illustrated in the same view as in FIG. 1A. Compared with the embodiment illustrated in FIG. 1A, an additional second layer 6 is provided in this case, which is arranged on spray coating 4 and which provides the function of densifying of stainless steel particles 2. This embodiment is useful in highly stressed locations.

Figure 2B:
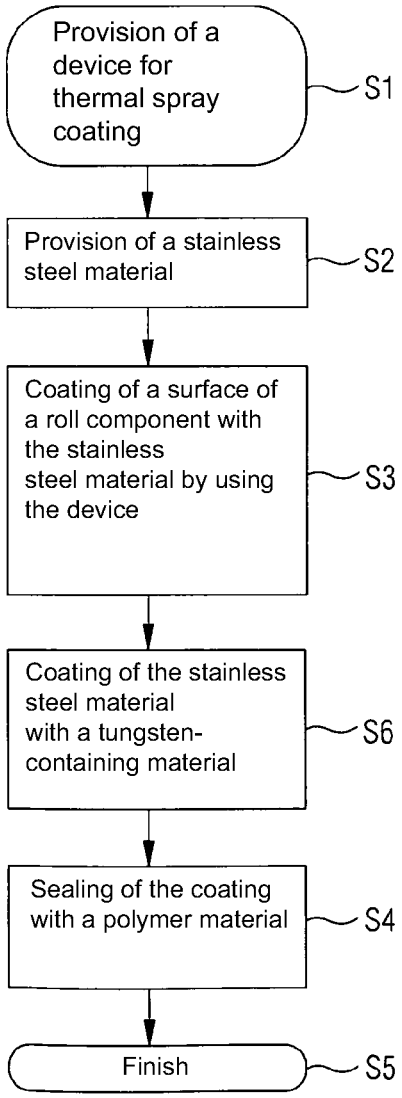
FIG. 2B illustrates the fundamental steps to produce a sealed spray layer in accordance with the embodiment shown in FIG. 1B.

In a process illustrated in FIG. 2B, additional 1 to 3 strokes hard metal are hereby applied in an additional process step S6. The same methods as for the application of spray coating 4 are available as application methods in this case. A repeated description is therefore foregone in this instance.

Carbides, nitrides or borides as well as composites thereof, as well as composites with other metals from the 4., 5. or 6. sub-group of the periodic table of elements can be used. Tungsten carbide can be specified as an exemplary carbide material.

Although this hard metal layer does not represent a dense closed layer, it does however compress the layer beneath it due to the high density of, for example the tungsten, so that one can operate from the basis of an increased corrosion resistance.

The present invention provides a more effective, durable and cost effective corrosion protection for roll components, rolls and in particular guide rolls for use in paper machines.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method application of a corrosion protective coating onto a roll component, the method comprising the steps of:

providing a device for thermal spray coating;

providing a stainless steel material;

using said device for thermal spray coating to apply said stainless steel material to coat at least one part of a surface of said roll component; and sealing said applied spray coating with a polymer material applied directly to said applied spray coating, said polymer material for sealing said applied spray coating comprising an epoxide resin in a non-cross-linked condition and a partially cross-linked condition, wherein said epoxide resin thoroughly wets a surface of said applied coating.

2. The method according to claim 1, wherein said device for thermal spray coating is arranged for implementation of one of high velocity flame spraying and laser spraying.

3. The method according to claim 1, wherein said stainless steel is in a fine powder form.

4. The method according to claim 1, wherein said device for thermal spray coating is arranged for implementation of arc spraying.

5. The method according to claim 1, wherein said stainless steel material is in a wire form.

6. The method according to claim 1, wherein said stainless steel material is a chrome-nickel-steel having a composition according to a material number of one of 1.4401, 1.4404, 1.4406, 1.4435, 1.4436 and 1.4440.

7. The method according to claim 1, wherein said coating of said surface of said roll component is through said application of said stainless steel material in a plurality of strokes.

8. The method according to claim 7, a number of said plurality of strokes for said application of said stainless steel material is a minimum of 4 strokes and a maximum of 6 strokes.

9. The method according to claim 1, wherein said polymer material for sealing said applied spray coating comprises a silicone polyester resin.

10. The method according to claim 1, said polymer material for sealing said applied spray coating includes a plurality of fillers embedded therein.

11. The method according to claim 10, said fillers including poly fluorinated ethylene.

12. The method according to claim 11, said fillers being polytetrafluor ethylene.

13. The method according to claim 10, said fillers being formed as particles.

14. The method according to claim 13, said particles having an average diameter in a range of between approximately 0.1 and 5 micrometers (μm).

15. The method according to claim 1, said polymer material comprising a poly fluorinated ethylene.

16. The method according to claim 15, said polymer material comprising polytetrafluor ethylene.

17. A roll component for a roll for use in a machine for production of paper, the roll component comprising:

a metallic base body;

one thermal spray coating formed of a stainless steel material covering at least a part of a surface of said metallic base body; and a polymer sealing layer applied directly to a surface of said thermal stainless steel spray coating, said polymer sealing layer applied to said surface comprising an epoxide resin in a non-cross-linked condition and a partially cross-linked condition, wherein said epoxide resin thoroughly wets said surface of said thermal stainless steel spray coating.

18. The roll component according to claim 17, wherein said stainless steel material is a chrome-nickel-steel having a composition according to a material number of one of 1.4401, 1.4404, 1.4406, 1.4435, 1.4436 and 1.4440.

19. The roll component according to claim 18, said polymer sealing layer including a silicone epoxide resin.

20. The roll component according to claim 18, said polymer sealing layer including polytetrafluor ethylene.

21. The roll component according to claim 17, said stainless steel material being one of a fine powder and in a wire form for said thermal spray coating, said thermal spray coating being one of high velocity flame spraying, laser spraying and arc spraying.

22. A roll, comprising:

a roll component including:

a metallic base body;

one thermal spray coating of a stainless steel material covering at least part of a surface of said metallic base body; and a polymer sealing layer applied directly to a surface of said thermal stainless steel spray coating, said polymer sealing layer applied to said surface comprising an epoxide resin in a non-cross-linked condition and a partially cross-linked condition, wherein said epoxide resin thoroughly wets said surface of said thermal stainless steel spray coating.

* * * * *